United States Patent [19]

Pretre

[11] Patent Number: 4,681,226

[45] Date of Patent: Jul. 21, 1987

[54] RECORDING BOX

[76] Inventor: Roger Pretre, 22, Rue de Sevres, Boulogne 92100, France

[21] Appl. No.: 819,593

[22] Filed: Jan. 17, 1986

[51] Int. Cl.[4] ..... B65D 85/67

[52] U.S. Cl. ..... 206/449; 206/815; 229/152; 282/8 R; 282/8 A

[58] Field of Search ..... 206/449, 815; 229/152; 282/8 R, 8 A, 9 R, 2, 11.5 R, 3 B; 225/48, 50, 53; 281/15 B, 45, 46

[56] References Cited

U.S. PATENT DOCUMENTS

| | | | |
|---|---|---|---|
| 760,697 | 5/1904 | Morton | 282/8 R |
| 854,483 | 5/1907 | Gass | 282/3 B |
| 1,173,830 | 2/1916 | Mecum | 282/3 B |
| 2,100,644 | 11/1937 | Groves | 229/152 |
| 2,843,307 | 7/1958 | Goltz | 229/143 |
| 3,182,792 | 5/1965 | Viltrakis | 206/449 |
| 3,334,921 | 8/1967 | Fischer | 282/8 R |

FOREIGN PATENT DOCUMENTS

| | | | |
|---|---|---|---|
| 1115415 | 5/1968 | United Kingdom | 206/449 |

*Primary Examiner*—William Price
*Assistant Examiner*—Jimmy G. Foster
*Attorney, Agent, or Firm*—Cushman, Darby & Cushman

[57] ABSTRACT

A portable recording box constituted of a blank made of cardboard or other analogous material which has cut-outs and folded lines so that the top, bottom, sides and writing surface of the box are assembled by folding and interlocking of the parts.

5 Claims, 7 Drawing Figures

RECORDING BOX

BRIEF SUMMARY OF INVENTION

The present invention relates to and has as one of its objects the providing of a lightweight and therefore portable recording box, made of cardboard or similar material with a sufficient rigidity, while having a certain flexibility.

A further object of the invention is to provide a box with a very low manufacturing cost, which may be thrown away after its contents have been used.

A further object of the invention is to provide a box which is formed of a blank made of cardboard or other material, having cut-outs and fold lines, so that the different sides of the box may be assembled by folding and interlocking.

A still further object of the invention is to provide a box that is divided, via the fold of the cardboard, into two superimposed compartments where the lower compartment, with a relatively large volume, serves to store a supply of fanfolded invoicing paper upon which the user will place written entries, for example, the record of the sale of goods in a store. The upper compartment serves for the introduction of the paper for the entries to be made. The lower compartment is closed on the top by a sheet of cardboard resulting from the folding of the initial blank, which gives the paper a sufficient foundation to permit writing the entries. A cover containing openings, maintained by interlocking above the level writing surface, guides and maintains the paper while allowing one to find out how much paper is left.

The detailed description which follows, with respect to the attached drawings, given by way of example, will permit a good understanding of how the invention may be achieved, the peculiar characteristics described, as well as those evident from the drawings belonging to the invention.

DETAILED DESCRIPTION OF AN EXEMPLARY EMBODIMENT

Figure 1:
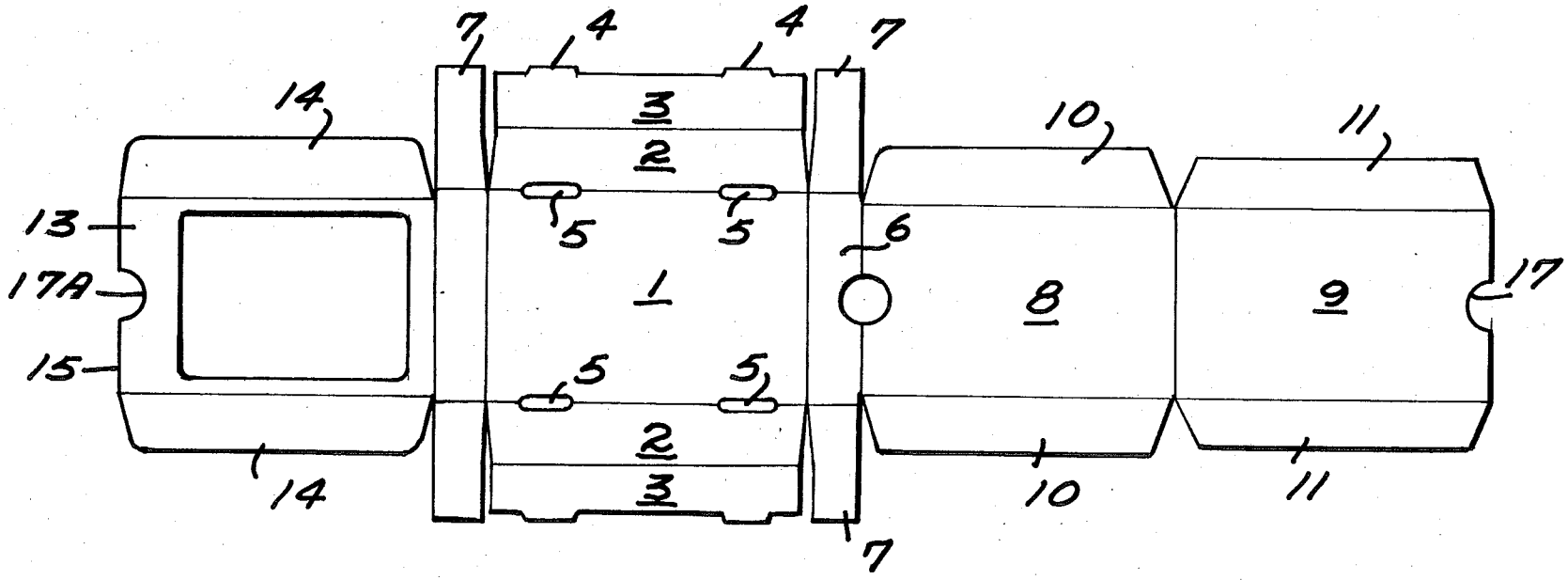
FIG. 1 represents the initial cardboard blank.
Figure 2:
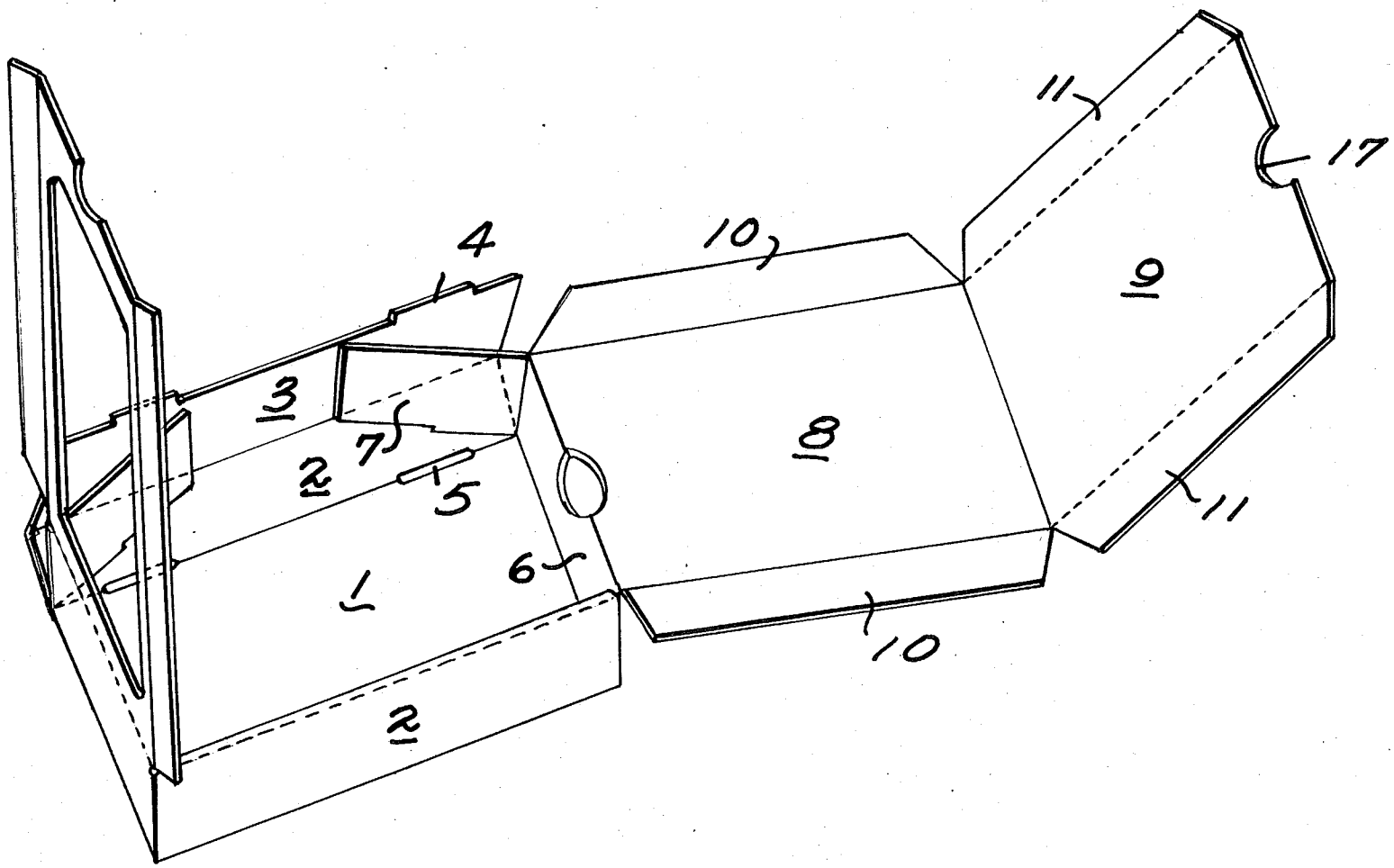
FIGS. 2, 3 and 4 are views, in perspective, illustrating the successive phases of the folding of the blank for the construction of the box.
Figure 3:
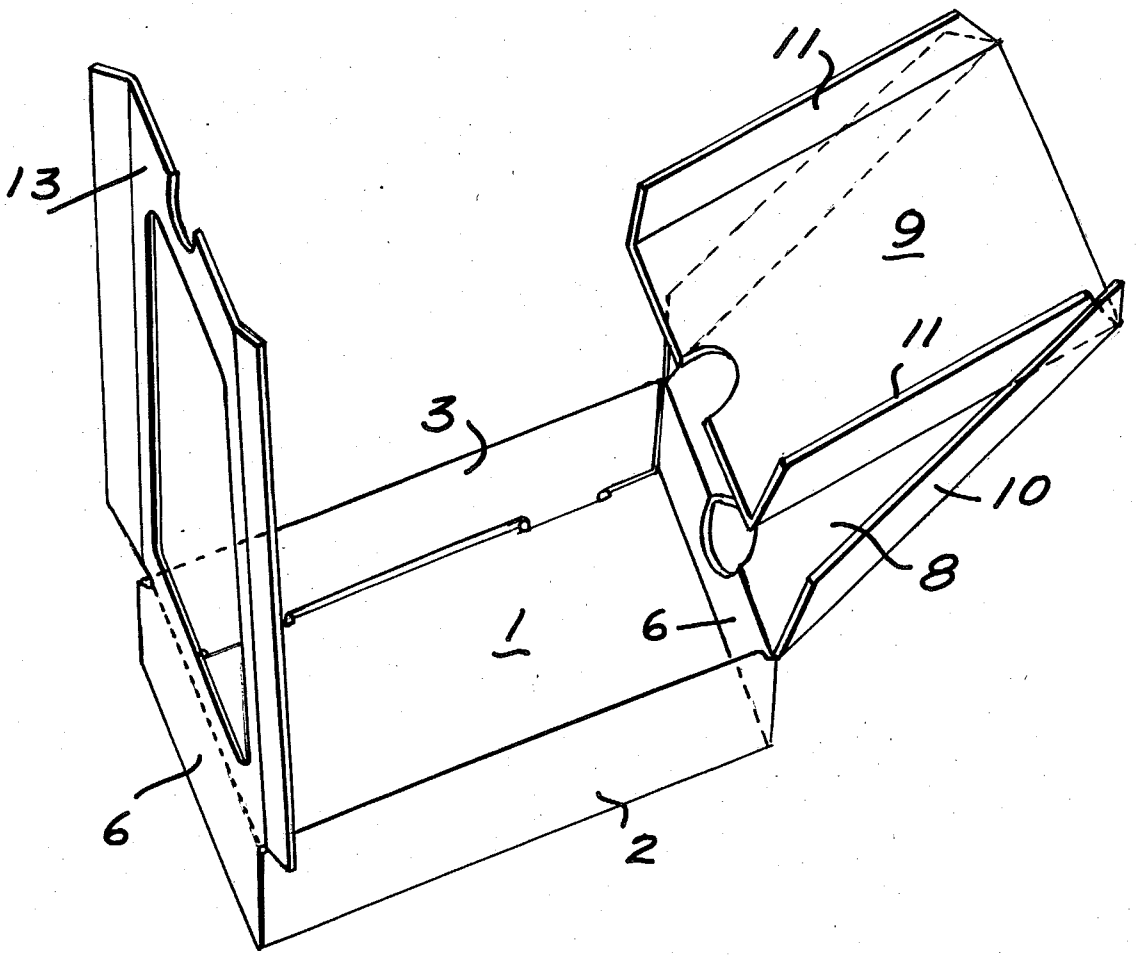
Figure 4:
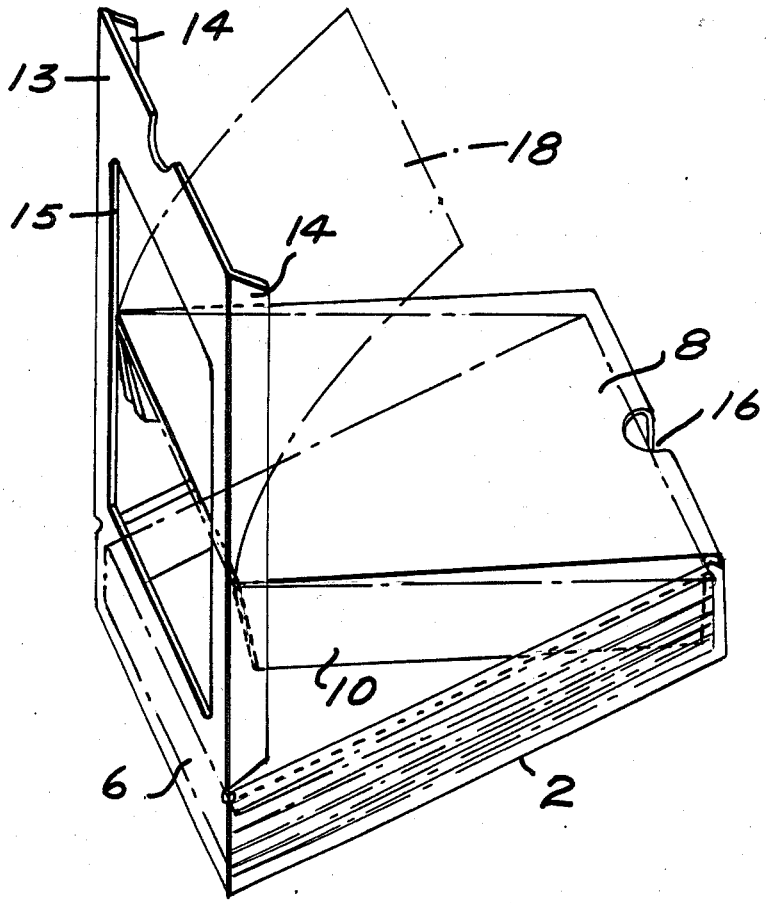
Figure 5:
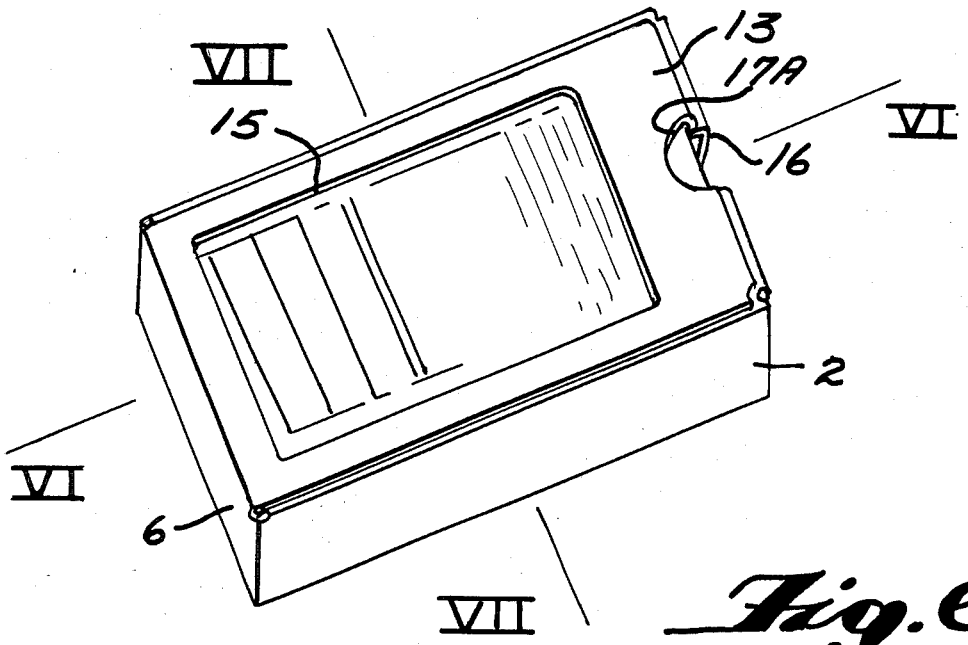
FIG. 5 shows, in perspective, a finished box.
Figure 6:
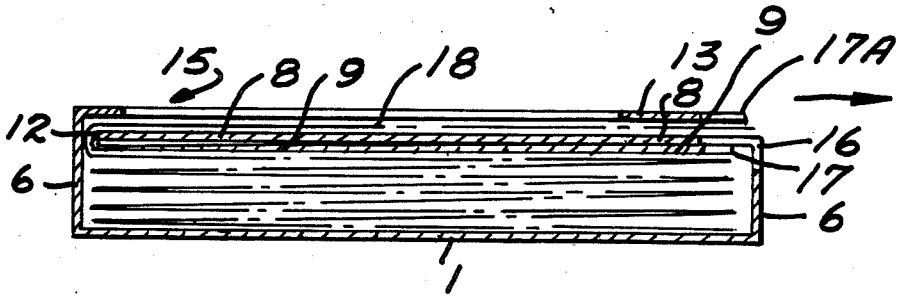
FIGS. 6 and 7 are cross sections of FIG. 5 along section lines VI—VI and VII—VII.
Figure 7:
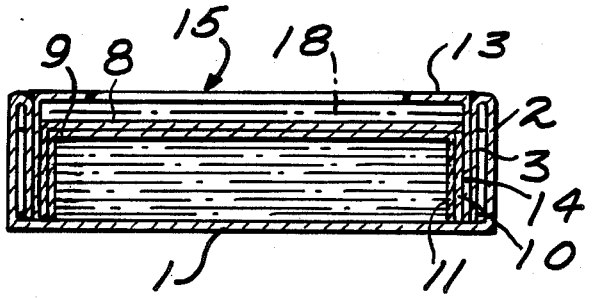

FIG. 1 shows the shape of a cardboard blank permitting one to obtain the box represented in FIGS. 5 to 7 by folding and interlocking.

In FIG. 1 the fine lines are fold lines, pressed into the cardboard using a wheel. The bold lines interior of the blank denote cut-out areas. Part 1 constitutes the bottom of the box. Parts 2 and 3 form the double-thick lengthwise sides, each part 3 being folded towards the inside of the box against the respective part 2 and being held in place by engaging the tongues 4 which jut into the oblong openings 5. Parts 6 constitute the crosswise sides and are extended via the tabs 7 which are engaged between parts 2 and 3, folded against each other before engaging the tongues 4 in the openings 5. Parts 8 and 9 with their edges 10 and 11 are designed to be refolded against each other, with interlocking of 11 into 10, and to proceed to form a level writing surface on the box. The length l of these parts is a little less than the corresponding size of the box, so as to furnish a slit 12 shown in FIG. 6. The length of the edge ab (see FIG. 1) of the side 6 of the box establishes the width of the space into which the paper will be able to be moved when it is pulled.

Part 13 with its interlocking edges 14 forms the upper part of the box. This part 13 has a cut-out area 15 so as to allow the useful portion of the paper to appear on which the entries must be made. The paper thus rests on the rather rigid level surface constituted by the superimposition of parts 8 and 9.

It will be noted that part 8 and adjoining part 6 are equipped on their fold line with a circular hole 16 and part 9 is equipped on its free edge with a semi-circular notch 17. Also, a semi-circular notch 17*a* exists in top part 13 (FIG. 1). When the box is assembled the hole 16 joins with the notches 17 and 17*a* to provide an opening (see FIG. 5) through which the user may take hold of and easily pull the paper 18 onto the level writing surface made up of parts 8 and 9. The paper, normally fanfolded, is housed in the lower compartment of the box. The fanfolded paper stored in the lower compartment is brought up through the slit 12. Pulling it out from the open ends of parts 8 and 9 brings more paper up through slit 12.

It is thus seen that the box described is light and therefore portable. Starting with a suitably cut and modified blank, which may be made by machine, the box may be constructed in a very simple manner without special assembly machinery. Therefore, it has a low manufacturing cost and may be thrown away when the paper supply is exhausted.

It will be understood that the foregoing description of an illustrative embodiment will permit others to conceive of modification of the invention. Therefore, the scope of the invention is to be determined from the appended claims.

What I claim is:

1. A recording box fabricated from a folded unitary blank for containing and dispensing fanfolded sheets, comprising:

a box having a bottom panel, first and second upstanding, lengthwise extending side panels connected to said bottom panel at respective first lengthwise fold lines, and first and second upstanding end panels connected to said bottom panel at respective first widthwise fold lines, said first and second end panels spaced a selected lengthwise dimension from one another;

an intermediate partition connected to one of said end panels along a second widthwise fold line and having means for positionally maintaining said intermediate partition superposed above and substantially parallel to said bottom panel, said intermediate partition having a length less than the lengthwise spacing dimension between said first and second end panels to define a slot between the other of said end panels and the remote end of said intermediate partition; and a top panel connected to the other of said end panels along a respective fold line and having means for positionally maintaining said top panel superposed above and substantially parallel to said intermediate partition to define a sheet passage therebetween, said top panel having a cut-out formed therein;

wherein a supply of edge-to-edge connected sheets is contained within the box between said bottom panel and the intermediate partition with the sheets passed through the slot and the sheet passage to provide access to a sheet through the cut-out, the intermediate partition functioning as a sheet support surface.

2. The recording box of claim 1, wherein each of said side panels comprises a first sub-panel connected to said bottom panel at said respective first-mentioned lengthwise fold line and a second sub-panel connected to said first sub-panel at a second lengthwise fold line, said first and second sub-panels folded substantially parallel to one another along the second lengthwise fold line.

3. The recording box of claim 2, wherein each side panel further comprises:

at least one tongue extending from an edge of said second sub-panel, said bottom panel having an opening formed therein for receiving said one tongue to positionally maintain said first and second sub-panels in their folded relationship.

4. The recording box of claim 3, wherein each of said end panels further comprises a lengthwise extending tab at each lateral end thereof, each tab restrained between the folded sub-panels of the adjacent side panel.

5. The recording box of claim 1, wherein said intermediate partition comprises a first sub-partition connected to said one end panel at said second widthwise fold line and a second sub-partition connected to said first sub-partition at a third widthwise fold line, said first and second sub-partitions folded substantially parallel to one another at the third widthwise fold line.

* * * * *

UNITED STATES PATENT AND TRADEMARK OFFICE

CERTIFICATE OF CORRECTION

PATENT NO. : 4,681,226

DATED : July 21, 1987

INVENTOR(S) : Roger PRETRE

It is certified that error appears in the above-identified patent and that said Letters Patent is hereby corrected as shown below:

On the Title page insert:

-- [73] Assignee: Moore Business Forms, Inc.

Grand Island, New York --.

Signed and Sealed this

Twenty-fourth Day of November, 1987

*Attest:*

DONALD J. QUIGG

*Attesting Officer*

*Commissioner of Patents and Trademarks*